US007565898B2

(12) United States Patent
Fukasawa

(10) Patent No.: US 7,565,898 B2
(45) Date of Patent: Jul. 28, 2009

(54) CONTROLLER FOR DIRECT INJECTION ENGINE AND CONTROLLING METHOD

(75) Inventor: Osamu Fukasawa, Nagoya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/492,926

(22) Filed: Jul. 26, 2006

(65) Prior Publication Data

US 2007/0028897 A1 Feb. 8, 2007

(30) Foreign Application Priority Data

Aug. 8, 2005 (JP) ..... 2005-229039

(51) Int. Cl.
*F02M 57/02* (2006.01)

(52) U.S. Cl. ..... 123/446; 123/299

(58) Field of Classification Search ..... 123/467, 123/497, 299, 300, 446; 701/112
See application file for complete search history.

(56) References Cited

U.S. PATENT DOCUMENTS

| | | | | |
|---|---|---|---|---|
| 5,651,347 | A * | 7/1997 | Oi et al. | 123/487 |
| 6,131,548 | A * | 10/2000 | Yano | 123/456 |
| 6,250,279 | B1 * | 6/2001 | Zack | 123/241 |
| 6,367,455 | B2 * | 4/2002 | Hirata et al. | 123/497 |
| 6,382,184 | B2 * | 5/2002 | Nakamura et al. | 123/464 |
| 6,868,826 | B1 * | 3/2005 | Oono | 123/339.1 |
| 6,970,775 | B2 * | 11/2005 | Lederle et al. | 701/29 |
| 7,079,941 | B2 * | 7/2006 | Tetsuno et al. | 701/112 |
| 2003/0066508 | A1 | 4/2003 | Nakayama et al. | |
| 2004/0007209 | A1 * | 1/2004 | Ohtani | 123/431 |
| 2004/0187840 | A1 | 9/2004 | Nakayama et al. | |
| 2005/0098157 | A1 | 5/2005 | Ohtani | |

FOREIGN PATENT DOCUMENTS

| | | | |
|---|---|---|---|
| JP | 10-331734 | | 12/1998 |
| JP | 11-315730 | | 11/1999 |
| JP | 2000328979 | A * | 11/2000 |
| JP | 2004-44506 | | 2/2004 |
| JP | 2004-232494 | | 8/2004 |
| JP | 2006-37736 | | 2/2006 |

OTHER PUBLICATIONS

Office Action mailed Jan. 26, 2009 in corresponding Japanese Application No. 2005-229039 with an at least partial English-language translation thereof.

* cited by examiner

*Primary Examiner*—Stephen K Cronin
*Assistant Examiner*—J. Page Hufty
(74) *Attorney, Agent, or Firm*—Nixon & Vanderhye P.C.

(57) ABSTRACT

An ECU feedback controls a discharge amount of a high-pressure pump in such a manner that a detected fuel pressure is consistent with a target fuel pressure. The ECU determines whether engine shut sown is imminent. When the ECU determines that engine shut down is imminent, the target fuel pressure is established lower than a normal fuel pressure. Since the engine is shut down in a condition where the fuel pressure is decreased, a fuel leakage from a fuel injector is unlikely.

21 Claims, 10 Drawing Sheets

FIG. 13
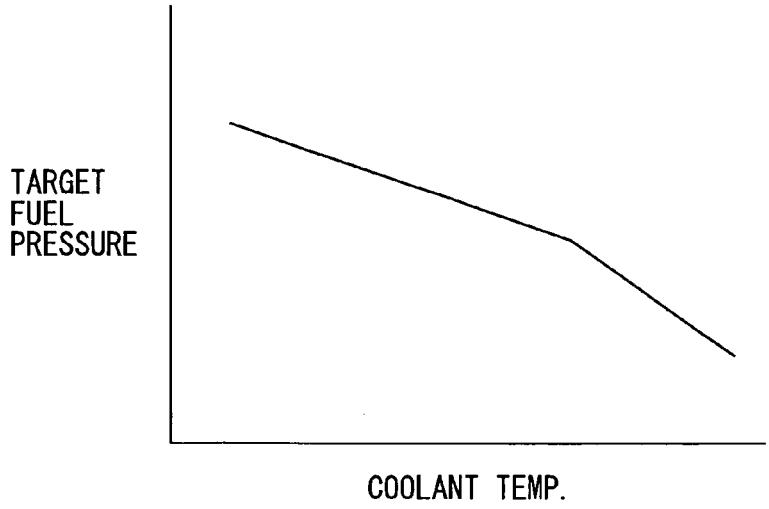
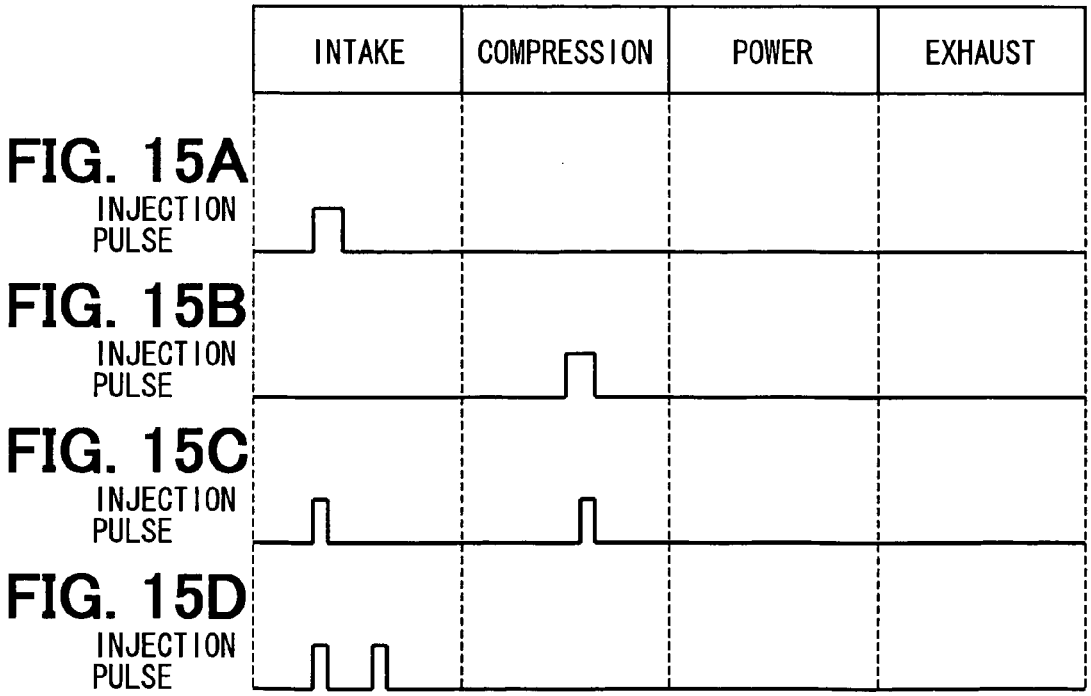

CONTROLLER FOR DIRECT INJECTION ENGINE AND CONTROLLING METHOD

CROSS REFERENCE TO RELATED APPLICATIONS

This application is based on Japanese Patent Applications No. 2005-229039 filed on Aug. 8, 2005, the disclosure of which is incorporated herein by reference.

FIELD OF THE INVENTION

The present invention relates to a controller for a direct injection engine which injects fuel directly into each combustion chamber and a controlling method for the same. The fuel is pressurized by a high-pressure pump and then is fed to a fuel injector

BACKGROUND OF THE INVENTION

JP-10-331734A shows a direct injection engine which is provided with a high-pressure pump. The high-pressure pump is driven by the engine to pressurize and atomize the fuel which is pumped up from a fuel tank by a low-pressure pump.

As shown by a dashed line in FIG. 3, the pressure of the fuel in a high-pressure pipe between the high-pressure pump and the fuel injector increases for a certain period after engine is shut down as a temperature of the engine increases due to residual heat of the engine. After the certain period has passed, the fuel pressure decreases as the temperature of the fuel decreases due to a natural radiation of heat from the engine. For instance, in a direct injection engine, since the fuel pressure at idle right before the engine is shut down (i.e. when engine shut down is imminent) remains high (for example, 8 MPa), the time period in which the fuel pressure remains high after the engine is shut down is prolonged. Furthermore, as shown in FIG. 4, as the fuel pressure increases while the engine is stopped, fuel leakage from the fuel injector is more likely. The leaked fuel may remain in the cylinder and may be expelled as unburned fuel, which may cause undesirable emissions during the next start of the engine.

JP-2004-232494 shows an intake port injection engine, which is provided with a fuel return pipe for returning the fuel in the fuel pipe to the fuel tank. The return pipe is provided with an orifice to reduce the fuel pressure by returning the fuel in the fuel pipe to the fuel tank through the orifice after the engine is shut down.

If such a return pipe having the orifice is applied to the direct injection engine, since the fuel is rapidly depressurized from high pressure to atmospheric pressure when passing through the orifice, a fuel vapor may be crated in the fuel returning to the fuel tank. It may cause a vapor lock at the next starting of the engine.

SUMMARY OF THE INVENTION

The present invention is made in view of the foregoing matter, and it is an object of the present invention to provide a controller for a direct injection engine capable of reducing a fuel leakage from the fuel injector after the engine is shut down, whereby the emission is reduced at starting of the engine.

According to the present invention, the controller includes a pressure detecting device for detecting a fuel pressure, a target fuel pressure establishing device for establishing a target fuel pressure according to a driving condition of the engine, a fuel pressure controlling device for controlling a discharge amount of the high-pressure pump in such a manner that the detected fuel pressure is consistent with the target fuel pressure; and a stop determining device for determining whether engine shut down is imminent. The target fuel pressure establishing device establishes the target fuel pressure lower than a normal fuel pressure when the stop determining device determines that engine shut down is imminent. The normal fuel pressure is fuel pressure for engine idling.

BRIEF DESCRIPTION OF THE DRAWINGS

The above and other objects, features, and advantages of the present invention will become more apparent from the following detailed description made with reference to the accompanying drawings, in which like parts are designated by like reference number and in which:

FIG. 13 is a chart conceptually showing a target pressure map at a time of engine stop:

FIGS. 15A-15D are charts for explaining fuel injection patterns;

DETAILED DESCRIPTION OF THE PREFERRED EMBODIMENTS

Embodiments of the present invention will be described hereinafter with reference to the drawings.

First Embodiment

Figure 1:
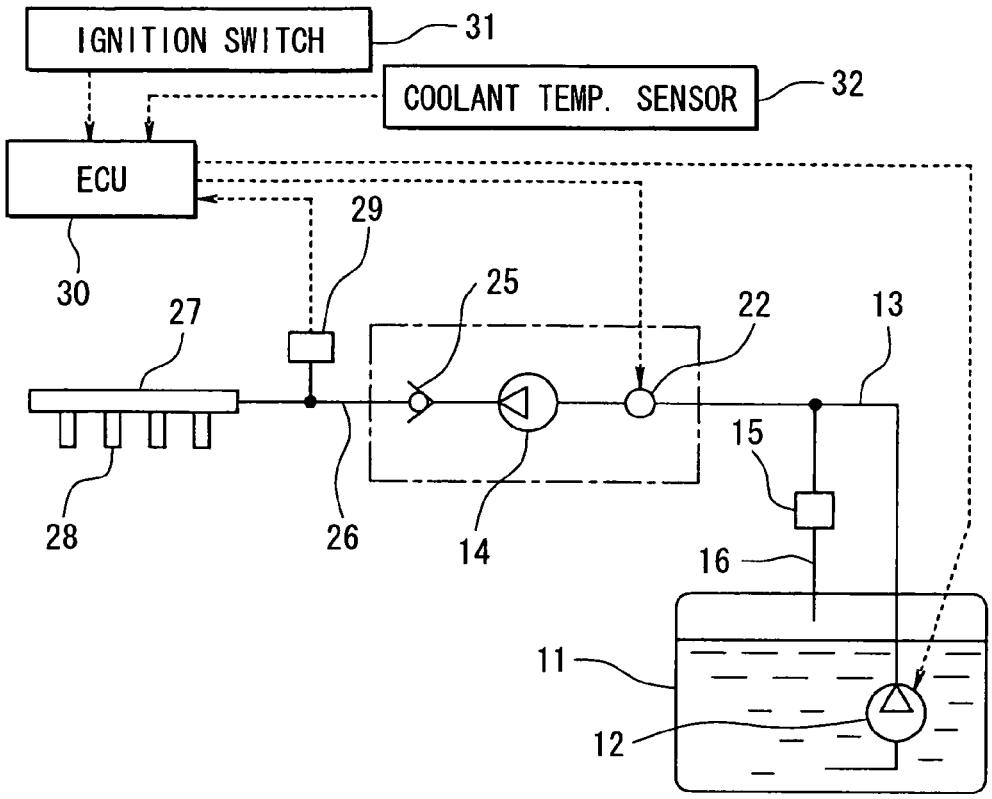
FIG. 1 is a schematic chart showing a fuel injection system according to a first embodiment.

FIG. 1 is a schematic view of a fuel supply system for a direct injection engine. A fuel tank 11 is provided with a low-pressure pump 12 pumping up fuel in the fuel tank 11. An electric motor (not shown) drives the low-pressure pump 12. The fuel discharged from the low-pressure pump 12 is introduced into a high-pressure pump 14 through a fuel pipe 13. A pressure regulator 15 is connected to the fuel pipe 13 such that the fuel pressure of the fuel discharged from the low-pressure pump 12 is adjusted to a predetermined pressure. Any surplus fuel exceeding the predetermined pressure is returned to the fuel tank 11 through a fuel return pipe 16.

Figure 2:
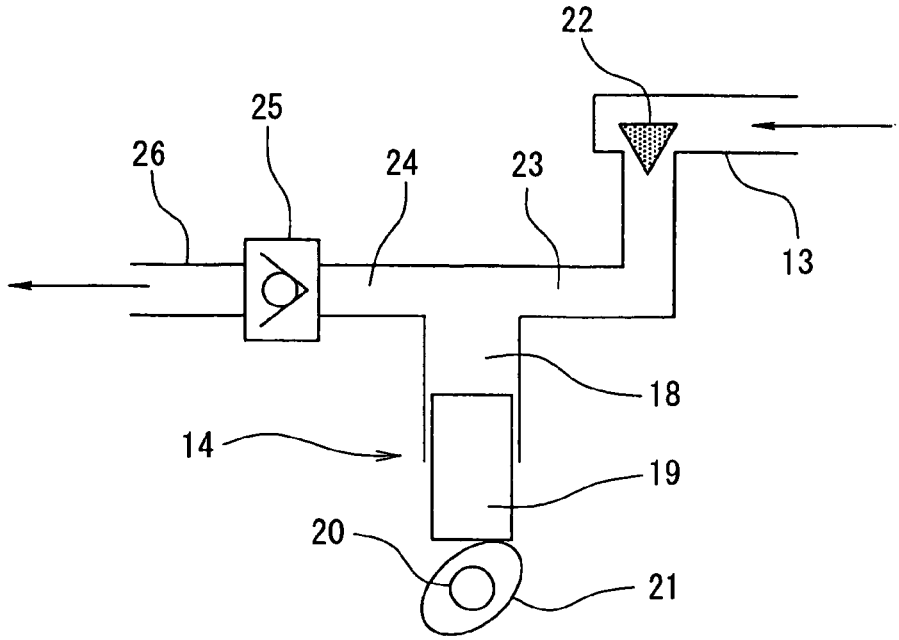
FIG. 2 is a schematic chart showing a high-pressure pump.

As show in FIG. 2, the high-pressure pump 14 is a piston pump having a piston 19 reciprocating in a pump chamber 18. A cam 21 connected to the camshaft 20 drives the piston 19 reciprocatively. A fuel pressure control valve 22 is provided at an inlet 23 of the high-pressure pump 14. The fuel pressure control valve 22 is a normally opened electromagnetic valve. When the high-pressure pump 14 is in a suction stroke, the fuel pressure control valve 22 is opened to intake the fuel. When the high-pressure pump 14 is in a discharge stroke, the fuel pressure control valve 22 is closed for a predetermined time period so that an amount of discharged fuel is adjusted to control the fuel pressure.

When it is required to increase the fuel pressure, a closing time of the fuel pressure control valve 22 is advanced so that a closing period of the fuel control valve 22 is prolonged to increase the discharge amount of the high-pressure pump 14. When it is required to decrease the fuel pressure, the closing timing of the fuel pressure control valve 22 is retarded so that the closing period of the fuel control valve 22 is shorted to decrease the discharge amount of the high-pressure pump 14.

A check valve 25 preventing a backward flow of the fuel is provided at an outlet 24 of the high-pressure pump 14. As shown in FIG. 1, the fuel discharged from the high-pressure pump 14 is introduced into the delivery pipe 27 through a high-pressure fuel pipe 26. The high-pressure fuel in the delivery pipe 27 is delivered to each fuel injector 28, which is respectively mounted on a cylinder head of the engine. The high-pressure fuel pipe 26 is provided with a fuel pressure sensor 29 detecting the fuel pressure. A coolant temperature sensor 32 is provided on a cylinder block of the engine.

Outputs from the sensors are inputted into an electronic control unit (ECU) 30. The ECU 30 is comprised of a microcomputer which feedback-controls the discharge amount of the high-pressure pump 14 so that the fuel pressure detected by the fuel pressure sensor 29 is consistent with a target fuel pressure.

Figure 5:
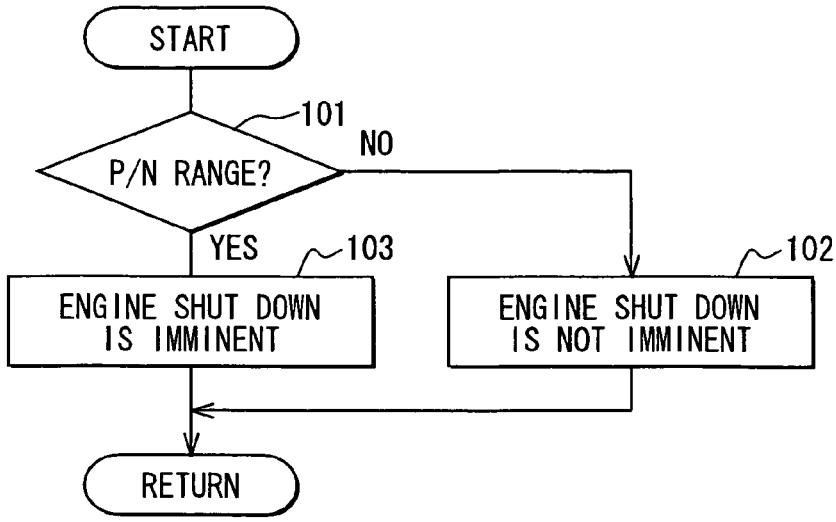
FIG. 5 is a flowchart showing an engine stop estimating routine.
Figure 6:
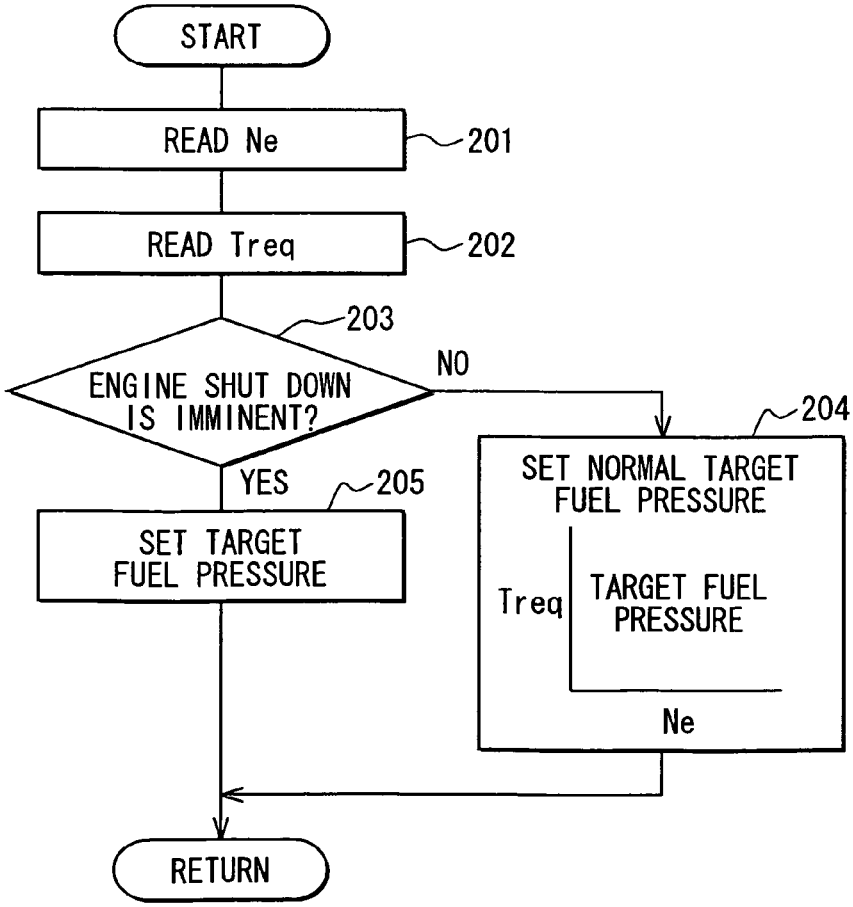
FIG. 6 is a flowchart showing a target fuel pressure calculating routine according to the first embodiment.

The ECU 30 executes routines shown in FIGS. 5 and 6 to establish the target fuel pressure. The ECU 30 determines whether engine shut down is imminent based on whether the shift lever position is switched to P-range (or N-range). That is, the ECU 30 estimates whether the engine will be shut down in a relatively short time. When the ECU 30 determines that engine shut down is imminent, the target fuel pressure is calculated based on the engine driving condition. When the ECU 30 determines that engine shut down is imminent, the target fuel pressure is established lower than the normal fuel pressure for idling the engine.

Hence, the engine is shut down in a situation that the fuel pressure in the high-pressure fuel pipe 26, the delivery pipe 27, and the like is decreased. The fuel pressure when the engine is stopped is lower than the normal fuel pressure at engine idling, so that a fuel leakage from the fuel injector 28 is unlikely while the engine is stopped.

Referring to FIGS. 5 and 6, the processes of each routine for establishing the target fuel pressure will be described hereinafter. An engine stop estimating routine shown in FIG. 5 is executed in a predetermined period while the ECU 30 is ON. In step 101, the computer of ECU 30 determines whether the shift lever position is switched from the D-range to the P-range (N-range). When the answer is NO, the procedure proceeds to step 102 in which the computer determines that engine shut down is imminent. When the answer is YES, the procedure proceeds to step 103 in which the computer determines that engine shot down is imminent. That is, the computer estimates the engine will be shut down in a relatively short time.

A target fuel pressure calculating routine shown in FIG. 6 is executed in a predetermined period while the ECU 30 is ON. The computer reads an engine speed Ne in step 201, and reads a required torque Treq in step 202.

Figure 7:
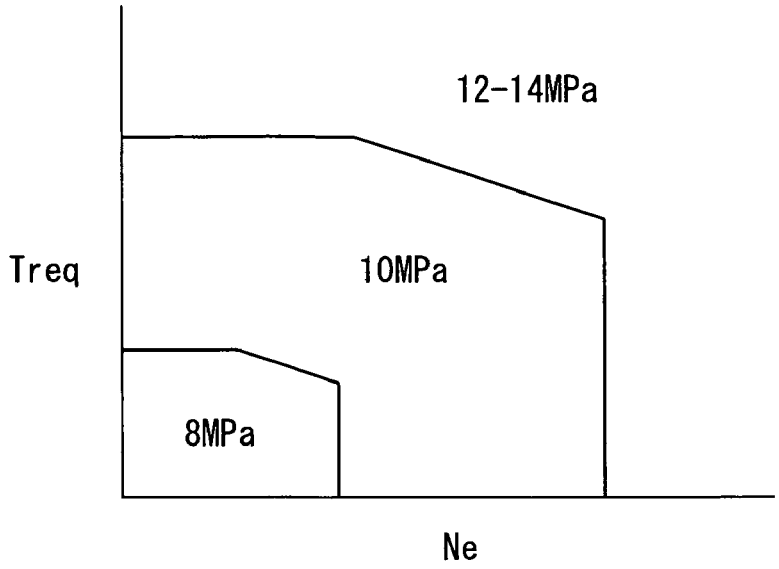
FIG. 7 is a chart conceptually showing a normal target fuel pressure map.

In step 203, the computer determines whether engine shut down is imminent based on the result of the engine stop estimating routine shown in FIG. 5. When the answer is NO, the procedure proceeds to step 204 in which the normal target fuel pressure is calculated based on the engine speed Ne and the required torque Treq by use of a normal target fuel pressure map shown in FIG. 7. Accordingly, as the engine speed Ne and/or the required torque Treq increases, the target fuel pressure is a higher value. For example, when the engine is in a low-speed and low-load condition (e.g. idling), the target fuel pressure is 8 MPa. When the engine is in an average-speed and average-load condition, the target fuel pressure is 10 MPa. When the engine is in a high-speed and high-load condition, the target fuel pressure is 12-14 MPa.

When the answer is YES in step 203, the procedure proceeds to step 205 in which the target fuel pressure is established. In one embodiment, this target fuel pressure is established in a range of 1 MPa-6 MPa, preferably 2 MPa-4 MPa, which is lower than a target fuel pressure at idling (for example, 8 MPa). In this embodiment, the target fuel pressure is 3 MPa.

Figure 3:
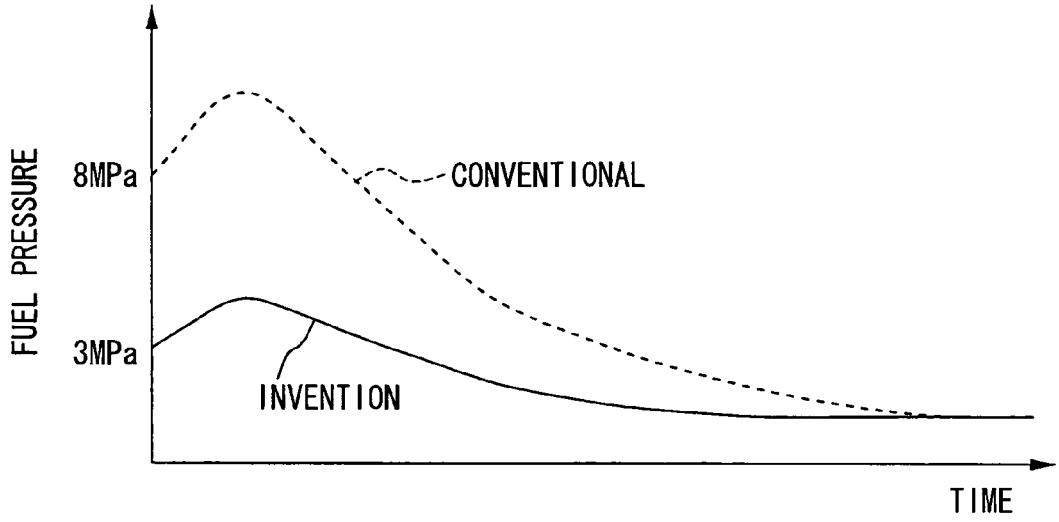
FIG. 3 is a graph showing a behavior of a fuel pressure while an engine is stopped.
Figure 4:
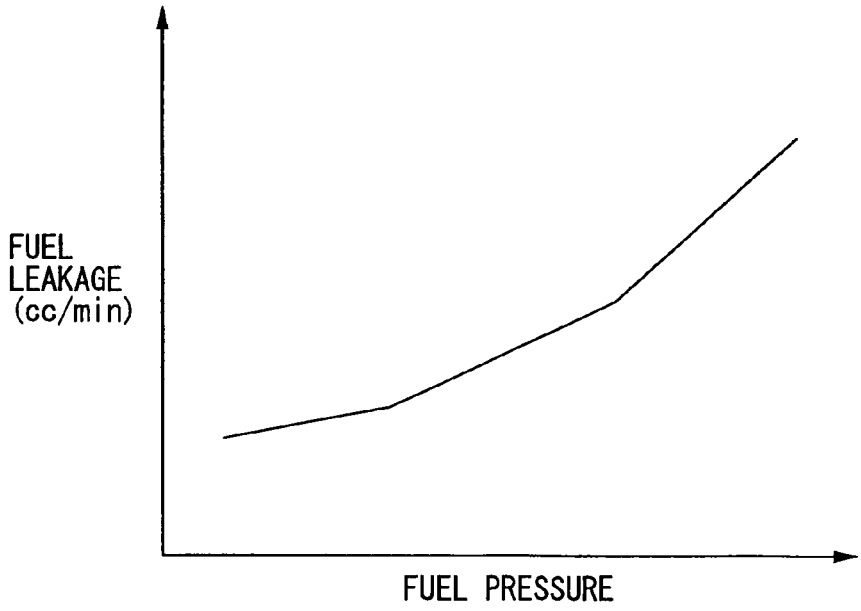
FIG. 4 is a graph showing a relationship between a fuel pressure and a fuel leakage.

According to the first embodiment described above, since the target fuel pressure at the time of engine stop is established lower than the normal target fuel pressure at idle, the engine can be shut down after the fuel pressure is decreased as shown in FIG. 3. Thus, the fuel pressure in the high-pressure fuel system can be reduced and the fuel leakage from the fuel injector 28 is unlikely while the engine is stopped, so that the emission at engine start can be reduced.

In the first embodiment, the computer determines whether engine shut down is imminent based on the engine stop estimating routine shown in FIG. 5. Instead of the routine shown in FIG. 5, one embodiment of the engine stop estimating routines shown in FIGS. 8 to 11 can be executed.

Figure 8:
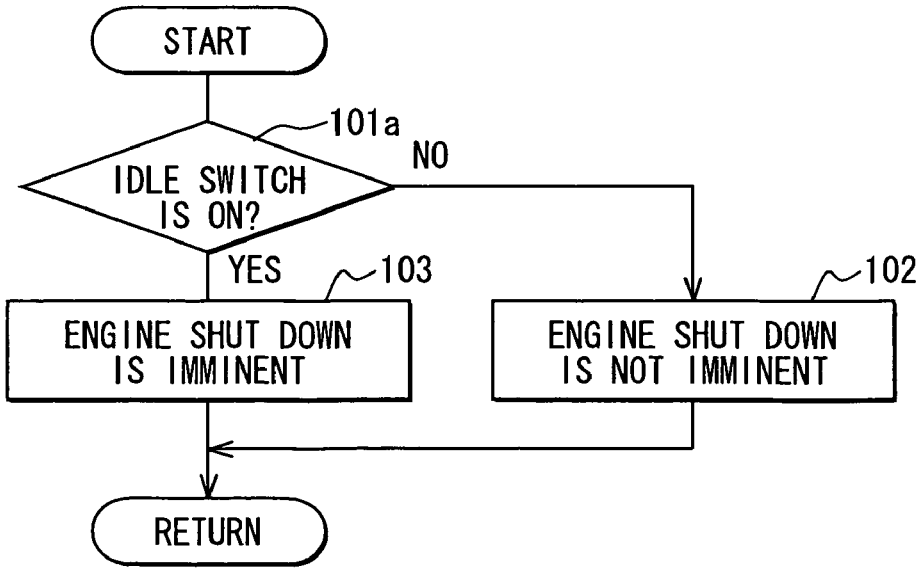
FIG. 8 is a flowchart showing an engine stop estimating routine.

In step 101*a* of the routine shown in FIG. 8, the computer determines whether engine shut down is imminent based on whether an idle switch is turned on. When the answer is NO, the procedure proceeds to step 102 in which the computer determines that engine shut down is not imminent. When the answer is YES, the procedure proceeds to step 103 in which the computer determines that engine shut down is imminent.

Figure 9:
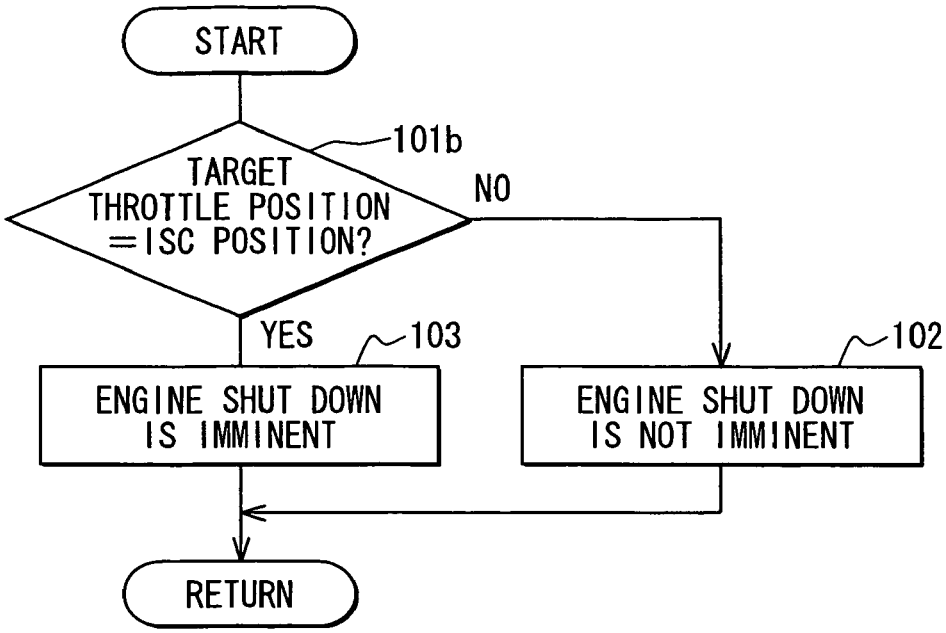
FIG. 9 is a flowchart showing an engine stop estimating routine.

In step 101*b* of the routine shown in FIG. 9, the computer determines whether engine shut down is imminent based on whether a target throttle position is established to an ISC position which represents a target throttle position during an idle speed controlling. When the answer is NO, the procedure proceeds to step 102 in which the computer determines that engine shut down is not imminent. When the answer is YES, the procedure proceeds to step 103 in which the computer determines that engine shut down is imminent.

Figure 10:
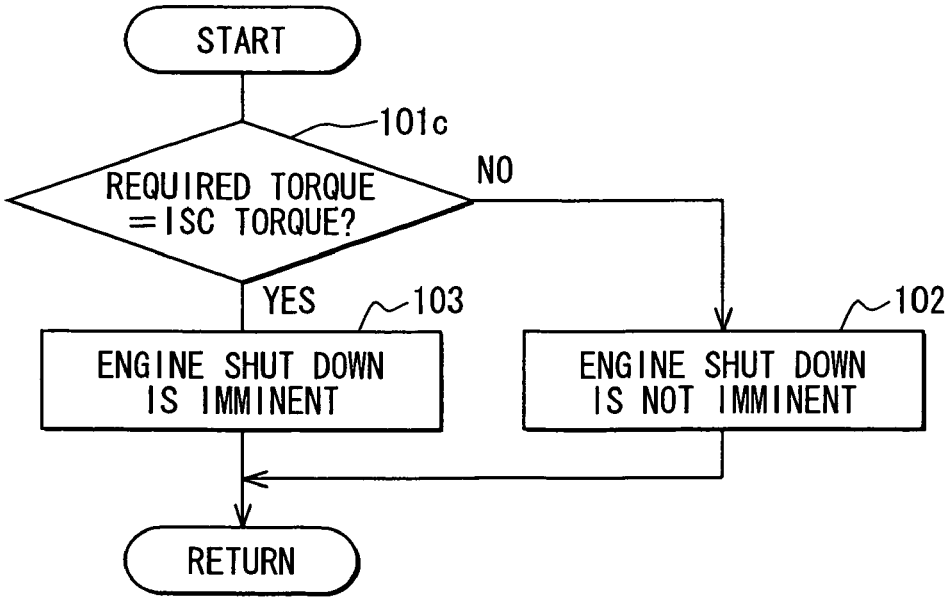
FIG. 10 is a flowchart showing an engine stop estimating routine.

In step 101*c* of the routine shown in FIG. 10, the computer determines whether engine shut down is imminent based on whether a required torque is approximately equal to an ISC torque, which represents a required torque during an idle speed controlling. When the answer is NO, the procedure proceeds to step 102 in which the computer determines that engine shut down is not imminent. When the answer is YES, the procedure proceeds to step 103 in which the computer determines that engine shut down is imminent.

Figure 11:
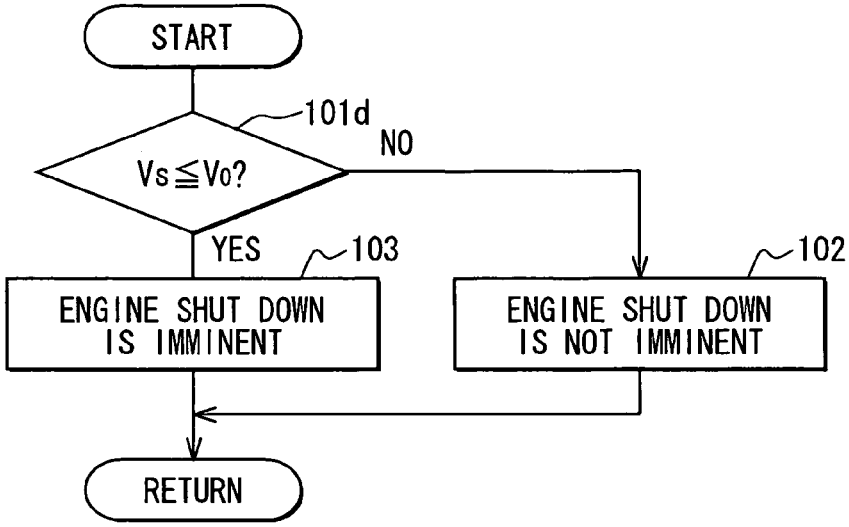
FIG. 11 is a flowchart showing an engine stop estimating routine.

In step 101*d* of the routine shown in FIG. 11, the computer determines whether engine shut down is imminent based on whether a vehicle speed Vs is lower than a predetermined speed V0. For example, when the vehicle speed is zero, the computer determines that engine shut down is imminent. When the answer is NO, the procedure proceeds to step 102 in which the computer determines that engine shut down is not imminent. When the answer is YES, the procedure proceeds to step 103 in which in which the computer determines that engine shut down is imminent.

It will be appreciated that two or more of the routines shown in FIGS. 5, 8-11 can be appropriately combined to estimate whether engine shut down is imminent.

Second Embodiment

Figure 12:
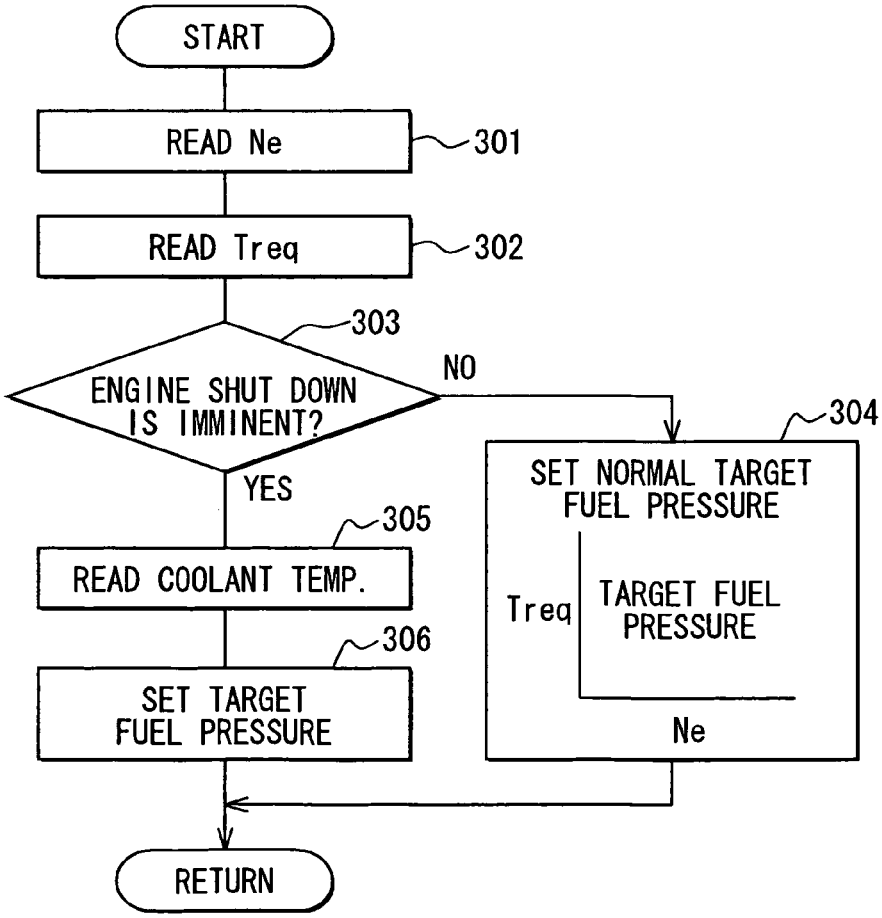
FIG. 12 is a flowchart showing a target fuel pressure calculating routine according to a second embodiment.

Referring to FIGS. 12 and 13, a second embodiment will be described hereinafter. In the second embodiment, a target fuel pressure calculating routine shown in FIG. 12 is executed, whereby the target fuel pressure at the time of engine stop is established based on an engine coolant temperature when the computer determines that engine shut down is imminent.

The engine speed Ne is read in step 301, and the required torque is read in step 302. In step 303, the computer determines whether engine shut down is imminent based on the result of at least one of the engine stop estimating routines described above.

When the answer is NO in step 303, the procedure proceeds to step 304 in which the normal target pressure is calculated based on the current engine speed and the required torque by use of the normal fuel pressure map.

When the answer is YES in step 303, the procedure proceeds to step 305 in which the engine coolant temperature is read. And then, the procedure proceeds to step 306 in which the target fuel pressure at the time of engine stop is established according to the current engine coolant temperature by use of a map shown in FIG. 13. In this map, as the engine coolant temperature decreases, the target fuel pressure increases in a range where the target fuel pressure is lower than the normal fuel pressure.

According to the second embodiment, since the target fuel pressure is established in such a manner as to increase the target fuel pressure as the engine coolant temperature decreases, an atomization of the fuel can be expedited even if the engine temperature is low and the combustibleness is deteriorated. Thus, the combustibleness can be ensured even when the engine coolant temperature is low.

Third Embodiment

Figure 14:
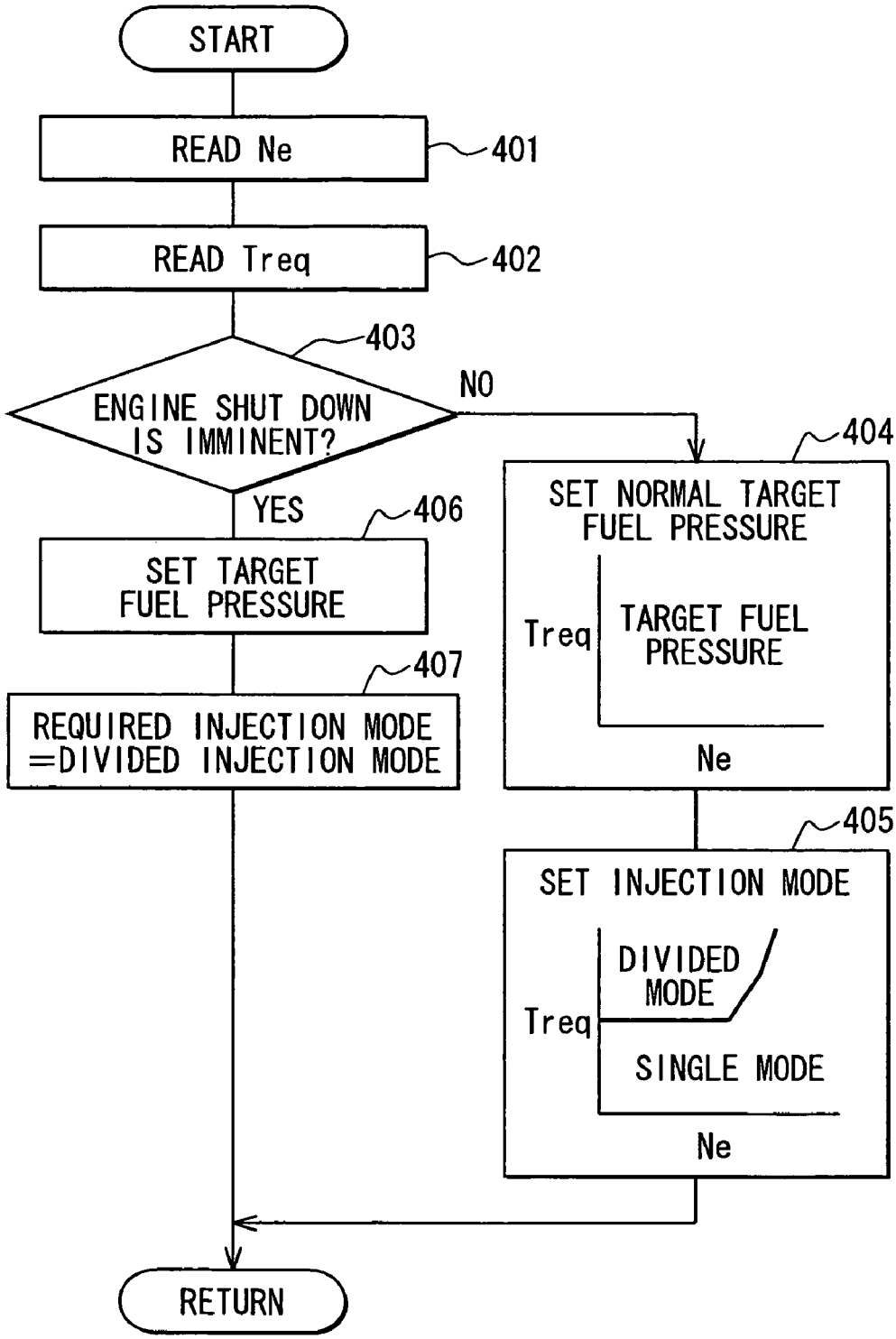
FIG. 14 is a flowchart showing a target fuel pressure calculating and an injection mode setting routine according to a third embodiment.

In a third embodiment, a target fuel pressure calculating and injection mode set routine shown in FIG. 14 is executed. When the computer determines engine shut down is not imminent, a required injection mode is switched between a single injection mode and a divided injection mode based on the engine driving condition. When the computer determines that engine shut down is imminent, the required injection mode is switched to the divided injection mode.

In the single injection mode, the fuel is injected into the cylinder once during one cycle of the combustion. In the divided injection mode, the fuel is injected into the cylinder multiple times during one cycle of the combustion.

The injection pattern in the divided injection mode can be changed based on the engine driving condition, a combustion mode, and the like. For example, in an injection pattern shown in FIG. 15C, the fuel is injected once during an intake stroke and then the fuel is injected once during a compression stroke. In an injection pattern shown in FIG. 15D, the fuel is injected twice during an intake stroke.

In the routine shown in FIG. 14, the engine speed Ne is read in step 401, the required torque Treq is read in step 402, and the computer determines whether engine shut down is imminent based on the result of the engine stop estimating routine in step 403.

When the answer is NO in step 403, the procedure proceeds to step 404 in which the normal fuel pressure is calculated based on the current engine speed Ne and the required torque Treq by use of the normal fuel pressure map. Then, the procedure proceeds to step 405 in which the required injection mode is switched between the single injection mode and the divided injection mode based on the current engine speed Ne and the required torque Treq by use of a required injection mode map.

When the answer is YES in step 403, the procedure proceeds to step 406 in which the target fuel pressure at the time of engine stop is established lower than the normal fuel pressure at idle. Then, the procedure proceeds to step 407 in which the required injection mode is switched to the divided injection mode.

According to the third embodiment described above, even if the target fuel pressure is decreased, the injection mode is switched to the divided injection mode when the computer determines engine shut down is imminent, and the injection period for one injection is reduced. Hence, the time period for atomization of the fuel is ensured to expedite the atomization of the fuel, so that a deterioration of the combustibleness is reduced.

Fourth Embodiment

Figure 16:
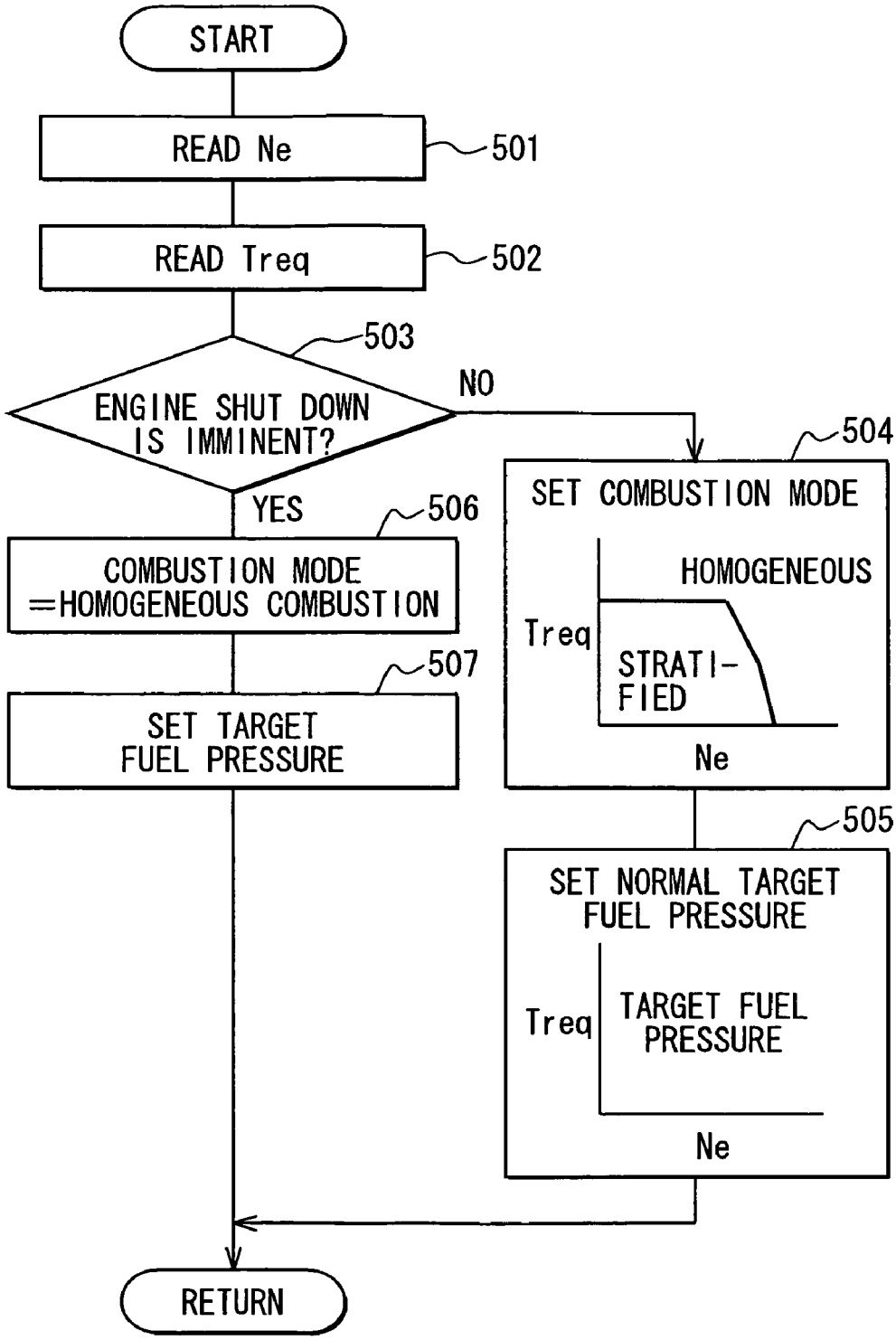
FIG. 16 is a flowchart showing a target fuel pressure calculating and combustion mode setting routine according to a fourth embodiment.

In a fourth embodiment, a target fuel pressure calculating and injection mode set routine shown in FIG. 16 is executed. When the computer determines engine shut down is not imminent, a required combustion mode is switched between a stratified combustion mode and a homogeneous combustion mode based on the engine driving condition. When the computer determines that engine shut down is imminent, the required combustion mode is switched to the homogeneous combustion mode.

In the stratified combustion mode, a small amount of the fuel is injected once during the compression stroke to improve fuel consumption as shown in FIG. 15B. In the homogeneous combustion mode, an increased amount of the fuel is injected once during the intake stroke to enhance the engine output as shown in FIG. 15A.

The engine speed Ne is read in step 501, the required engine torque Treq is read in step 502, and the computer determines whether engine shut down is imminent in step 503.

When the answer is NO in step 503, the procedure proceeds to step 504 in which the required combustion mode is switched between the stratified combustion mode and the homogeneous combustion mode based on the current engine speed Ne and the required torque Treq by use of the required combustion mode map. Then, the procedure proceeds to step 505 in which the normal fuel pressure is calculated based on the current engine speed Ne and the required torque Treq by use of the normal target fuel pressure map.

When the answer is YES in step 503, the procedure proceeds to step 506 in which the required combustion mode is switched to the homogeneous combustion. Then, the procedure proceeds to step 507 in which the target fuel pressure at the time of engine stop is set lower than the normal target fuel pressure at idling.

When the engine is in the stratified combustion mode at the time of engine stop, a time period for atomizing the fuel may be insufficient and may deteriorate the combustion condition. However, according to the fourth embodiment, even if the target fuel pressure is decreased, since the combustion mode is switched to the homogeneous combustion mode at the time of engine stop, the time period for atomizing the fuel is ensured to expedite the atomization of the fuel, so that a deterioration of the fuel combustibleness is reduced.

Fifth Embodiment

Figure 17:
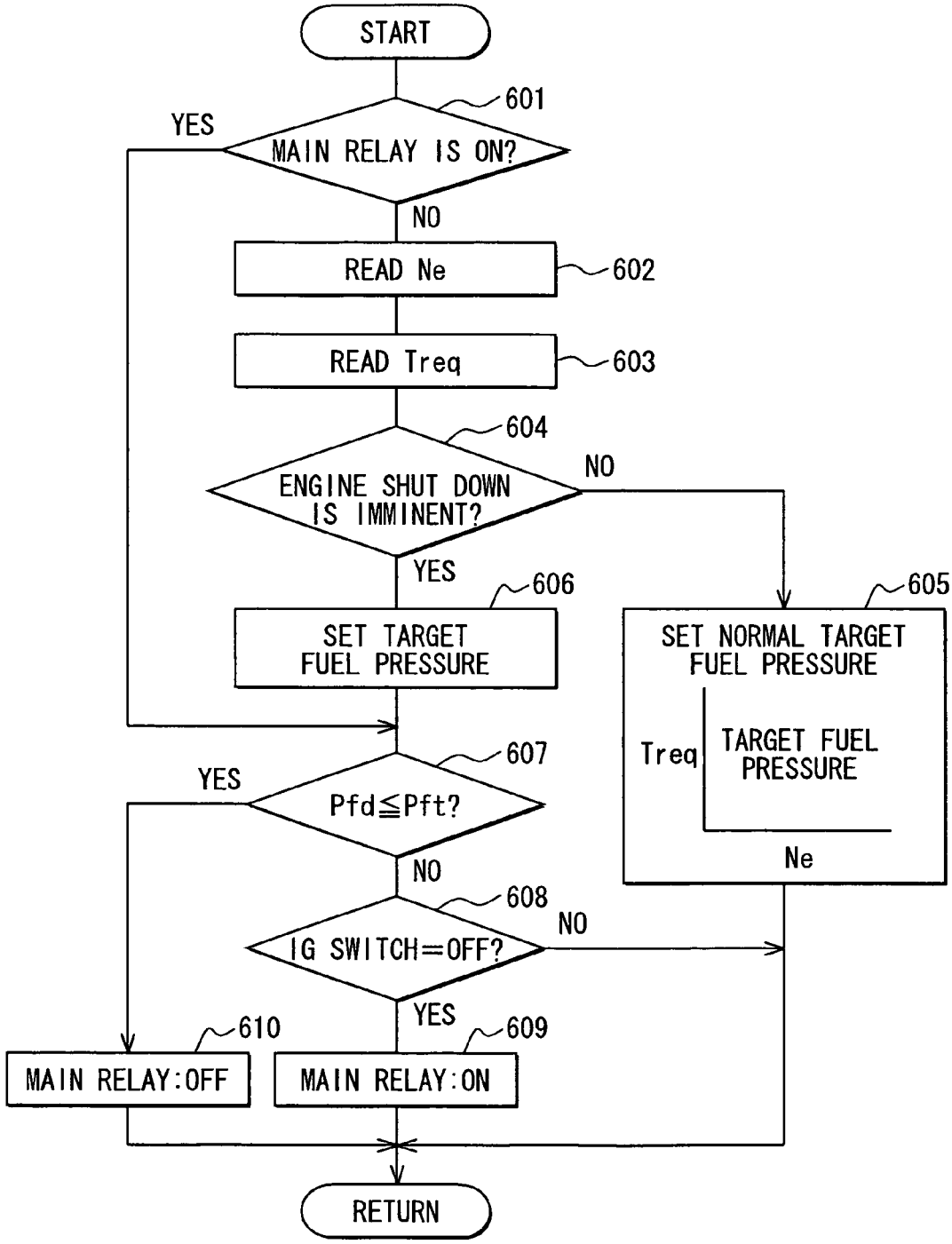
FIG. 17 is a flowchart showing a target fuel pressure calculating and a main relay controlling routine.

In some situations, an ignition switch may be turned off to stop the fuel injection before the fuel pressure is reduced to the target fuel pressure. However, according to a fifth embodiment, a target fuel pressure calculating and main controlling routine shown in FIG. 17 is executed, whereby a main relay (not shown) is maintained ON until the detected fuel pressure is decreased to the target fuel pressure so that the fuel injection and the ignition is continued by keeping energization of the ECU 30, the fuel pressure senor 29, the fuel injector 28, and an igniter.

In step 601, the computer determines whether the main relay is turned ON after the ignition switch 31 is turned OFF. When the answer is NO, the engine speed Ne is read in step 602, the required engine torque Treq is read in step 603, and the computer determines whether engine shut down is imminent in step 604.

When the answer is NO in step 604, the procedure proceeds to step 605 in which the normal fuel pressure is calculated based on the current engine speed Ne and the required torque Treq by use of the normal target fuel pressure map.

When the answer is YES in step 604, the procedure proceeds to step 606 in which the target fuel pressure is established lower than the normal target fuel pressure at idling.

Then, the procedure proceeds to step 607 in which the computer determines whether the detected fuel pressure Pfd is lower than or equal to the target fuel pressure Pft. When the answer is NO in step 607, the procedure proceeds to step 608 in which the computer determines whether the ignition switch 31 is turned OFF. When the ignition switch is turned OFF, the procedure proceeds to step 609 in which the main relay is forcibly turned ON so that the fuel injection and the ignition are continued until the detected fuel pressure becomes the target fuel pressure.

When the answer is YES in step 607, the procedure proceeds to step 610 in which the main relay is turned OFF.

According to the fifth embodiment described above, the main relay is turned ON until the detected fuel pressure is decreased to the target fuel pressure. Thus, even if the ignition switch is tuned OFF before the detected fuel pressure is decreased to the target fuel pressure, the fuel injection and the ignition are continued until the detected fuel pressure is decreased to the target fuel pressure, so that the fuel leakage from the fuel injector 28 is unlikely while the engine is stopped.

In the first to fifth embodiments, when the computer determines that engine shut down is imminent, the target fuel pressure is established lower than the normal fuel pressure. In one embodiment, if the system initially determines that engine shut down is imminent but then recognizes that the engine remains ON for a predetermined time, the system will return the target fuel pressure to the normal target fuel pressure.

What is claimed is:

1. A controller for a direct injection engine, the direct injection engine having a low-pressure pump pumping up fuel in a fuel tank and a high-pressure pump pressurizing a fuel which is directly injected into a cylinder through a fuel injector at a normal fuel pressure for engine idling, the controller comprising:

a pressure detecting device for detecting a fuel pressure which is supplied to the fuel injector;

a target fuel pressure establishing device for establishing a target fuel pressure according to a driving condition of the engine;

a fuel pressure controlling device for controlling a discharge amount of the high-pressure pump in such a manner that the detected fuel pressure is consistent with the target fuel pressure, the fuel being introduced to the high-pressure pump by the low-pressure pump;

a stop determining device for determining whether engine shut down is imminent; and a coolant temperature detecting device for detecting a temperature of an engine coolant;

wherein the target fuel pressure establishing device establishes the target fuel pressure lower than the normal fuel pressure when the stop determining device determines that engine shut down is imminent and then the high-pressure pump is controlled so as to discharge the fuel at the target fuel pressure lower than the normal fuel pressure, and as the temperature of the engine coolant decreases, the target pressure establishing device increases the target pressure in a range where the target fuel pressure is lower than the normal fuel pressure.

2. A controller according to claim 1, wherein the stop determining device determines whether engine shut down is imminent based on at least one of an idle command, a position of a shift lever, and a vehicle speed.

3. A controller according to claim 1, further comprising:

an injection mode switching device for switching an injection mode between a single injection mode in which the fuel is injected once during one cycle of a combustion and a divided injection mode in which the fuel is injected a plurality of times during one cycle of the combustion, wherein the injection mode switching device switches the injection mode from the single injection mode to the divided injection mode when the stop determining device determines that engine shut down is imminent.

4. A controller according to claim 1, further comprising:

a combustion mode switching device for switching a combustion mode between a homogeneous combustion mode in which the fuel is injected during a intake stroke and a stratified combustion mode in which the fuel is injected during a compression stroke, wherein the combustion mode switching device switches the combustion mode from the stratified combustion mode to the homogeneous combustion when the stop determining device determines that engine shut down is imminent.

5. A controller according to claim 1, further comprising: a relay device for continuing a fuel injection and an ignition until the detected fuel pressure is decreased to the target fuel pressure after an ignition switch is turned off.

6. A controller for a direct injection engine, the direct injection engine having a low-pressure pump pumping up fuel in a fuel tank and a high-pressure pump pressurizing a fuel which is directly injected into a cylinder through a fuel injector at a normal fuel pressure for engine idling, the controller comprising:

a pressure detecting means for detecting a fuel pressure which is supplied to the fuel injector;

a target fuel pressure means for establishing a target fuel pressure according to a driving condition of the engine;

a fuel pressure controlling means for controlling a discharge amount of the high-pressure pump in such a manner that the detected fuel pressure is consistent with the target fuel pressure, the fuel being introduced to the high-pressure pump by the low-pressure pump;

a stop means for determining whether engine shut down is imminent; and a coolant temperature detecting device for detecting a temperature of an engine coolant;

wherein the target fuel pressure means establishes the target fuel pressure lower than the normal fuel pressure when the stop means determines that the engine shut down is imminent and then the high-pressure pump is controlled so as to discharge the fuel at the target fuel pressure lower than the normal fuel pressure, and as the temperature of the engine coolant decreases, the target fuel pressure means increases the target pressure in a range where the target fuel pressure is lower than the normal fuel pressure.

7. A controlling method for a direct injection engine, the direct injection engine having a high-pressure pump pressurizing a fuel which is directly injected into a cylinder through a fuel injector at a normal fuel pressure for engine idling, the controlling method comprising:

detecting a fuel pressure representing a pressure of the fuel which is supplied to the fuel injector;

establishing a target fuel pressure according to a driving condition of the engine; controlling a discharge amount of the high-pressure pump in such a manner that the detected fuel pressure is consistent with the target fuel pressure;

determining whether engine is shut down is imminent; and detecting a temperature of an engine coolant;

wherein the target fuel pressure is established lower than the normal fuel pressure when it is determined that engine shut down is imminent and then the high-pressure pump is controlled so as to discharge the fuel at the target fuel pressure lower than the normal fuel pressure, and as the temperature of the engine coolant decreases, the target fuel pressure is increased in a range where the target fuel pressure is lower than the normal fuel pressure.

8. A controller for a direct injection engine according to claim 1, wherein the high-pressure pump is driven by a cam connected to a camshaft of the engine.

9. A method according to claim 7, wherein determining whether engine shut down is imminent is based an idle command, a position of a shift lever, and/or a vehicle speed.

10. A method according to claim 7, further comprising:

switching an injection mode between a single injection mode in which the fuel is injected once during one cycle of a combustion and a divided injection mode in which the fuel is injected a plurality of times during one cycle of the combustion, wherein the injection mode is switched from the single injection mode to the divided injection mode upon determination that engine shut down is imminent.

11. A method according to claim 7, further comprising:

switching a combustion mode between a homogeneous combustion mode in which the fuel is injected during a intake stroke and a stratified combustion mode in which the fuel is injected during a compression stroke, wherein the combustion mode is switched from the stratified combustion mode to the homogeneous combustion upon determination that engine shut down is imminent.

12. A controller according to claim 1, wherein the high-pressure pump is driven by a cam mechanism.

13. A controller according to claim 1, wherein the high-pressure pump is provided with a fuel pressure control valve by which the discharge amount of the high-pressure pump is controlled so that the fuel pressure is controlled.

14. A controller according to claim 13, wherein the discharge amount of the high-pressure pump is controlled by controlling a closing period of the fuel pressure control valve.

15. A controller according to claim 14, wherein a closing time of the fuel pressure control valve is advanced to increase the fuel pressure and the closing time of the fuel pressure control valve is retarded to decrease the fuel pressure.

16. A controller according to claim 13, wherein the fuel pressure control valve is arranged in a fuel pipe between the high pressure pump and the low pressure pump.

17. A controller according to claim 6 wherein the high-pressure pump is driven by a cam mechanism.

18. A controller according to claim 6 wherein the high-pressure pump is provided with a fuel pressure control valve by which the discharge amount of the high-pressure pump is controlled so that the fuel pressure is controlled.

19. A controller according to claim 18, wherein the discharge amount of the high-pressure pump is controlled by controlling a closing period of the fuel pressure control valve.

20. A controller according to claim 19, wherein a closing time of the fuel pressure control valve is advanced to increase the fuel pressure and the closing time of the fuel pressure control valve is retarded to decrease the fuel pressure.

21. A controller according to claim 18, wherein the fuel pressure control valve is arranged in a fuel pipe between the high pressure pump and the low pressure pump.

* * * * *